US007207145B2

(12) United States Patent
Stucky et al.

(10) Patent No.: US 7,207,145 B2
(45) Date of Patent: Apr. 24, 2007

(54) SIDING PANEL TAB AND SLOT JOINT

(75) Inventors: David J. Stucky, Grass Lake, MI (US); Robert D. Shaw, Parma, MI (US); Stephen W. Steffes, McPherson, KS (US)

(73) Assignee: CertainTeed Corporation, Valley Forge, PA (US)

( * ) Notice: Subject to any disclaimer, the term of this patent is extended or adjusted under 35 U.S.C. 154(b) by 388 days.

(21) Appl. No.: 10/697,479

(22) Filed: Oct. 30, 2003

(65) Prior Publication Data

US 2005/0102946 A1 May 19, 2005

(51) Int. Cl.
*E04D 1/00* (2006.01)

(52) U.S. Cl. ..... 52/555; 52/520; 52/535; 52/542; 52/748.1

(58) Field of Classification Search ..... 52/748.1, 52/526, 577, 542, 555, 520, 524, 525, 535
See application file for complete search history.

(56) References Cited

U.S. PATENT DOCUMENTS 2,035,369 A * 3/1936 Harshberger ..... 52/526
2,078,998 A * 5/1937 Black ..... 52/526
3,228,164 A * 1/1966 Ettore ..... 52/539
4,280,311 A 7/1981 Lockard
5,347,784 A * 9/1994 Crick et al. ..... 52/520
6,301,856 B1 * 10/2001 Nasi ..... 52/712
6,336,303 B1 * 1/2002 Vandeman et al. ..... 52/520
6,715,250 B2 * 4/2004 Bryant et al. ..... 52/528
6,955,019 B2 * 10/2005 Donlin et al. ..... 52/520

* cited by examiner

*Primary Examiner*—Naoko Slack
*Assistant Examiner*—Jessica Laux
(74) *Attorney, Agent, or Firm*—Duane Morris, LLP

(57) ABSTRACT

A panel for polypropylene injection molded siding, and for similar materials and/or uses, is mounted in lapped courses with panels attached at butt joints in a direction of elongation. Complementary tabs and slots at the panel ends can be engaged by end-to-end approach of the abutting panels. Additionally, openings for the tabs permit engagement from a position in which the panel ends are already overlapped, which reduces or eliminates the need for endwise assembly space. The slots can be discontinuous on one or both sides, openings permitting lateral insertion of the tabs at gaps, whereupon movement of the tabs along the slots engages the joint. The panels can simulate wood siding and include a step between simulated courses. A gap is provided in the edge of the panel at the step, thus forming an opening for the tab to enter and move along the slot.

17 Claims, 5 Drawing Sheets

SIDING PANEL TAB AND SLOT JOINT

BACKGROUND OF THE INVENTION

The invention relates to panels for facing the surfaces of building structures, particularly elongated siding panels installed in lapped courses on exterior walls. In particular, a joint is provided for the ends of abutting panels in a course, with tabs and openings that permit engagement by alternative movements.

PRIOR ART

Siding products can simulate traditional materials such as wooden clapboards, cedar shakes and the like. Traditional wood siding materials are installed in overlapped single tiers or courses. Each wood clapboard course typically consists of a row of horizontally elongated planks (clapboards), butted end to end. Similarly, shingle or shake siding typically consists of horizontally aligned rows of single laterally-adjacent shingles or shakes. Except at the extreme top and bottom, each row is overlapped at its top edge by a next higher course, and in turn laps over a next lower course, to the edges of the sided area.

Modern versions of such building siding use molded or extruded materials to simulate traditional siding materials. Usually, each integral molded or extruded panel piece represents two or more rows of traditional wood pieces. In the case of clapboards, for example, two or more horizontally-elongated vertically-lapped boards are simulated by one integral panel of siding.

The panel can comprise a relatively thin sheet that is shaped to simulate thickness. For example, in cross section the outer surface of a panel simulating two or more courses can be stepped in a shallow sawtooth contour. The exterior surface of the siding panel has upper and lower inclined surfaces, each representing the outer face of a wooden clapboard or shingle. The stepped edge between the upper and lower inclined surfaces represents the lower edge of the upper board. In the case of shakes or shingles, in addition to including two or more vertical courses, an integral panel of siding also represents a number of horizontally adjacent usually-staggered discrete shingles or shakes, separated by narrow gaps.

Although each molded siding panel typically simulates plural wooden courses, the siding panel laps over a lower panel of the same type, and is itself lapped over by an upper siding panel, in much the same way that wood courses overlap. Siding panels typically are fastened to the building using nails or other fasteners along a nailing strip provided along the top edge of each siding course. The nailing strip is overlapped and concealed by the next higher course of siding.

The siding panels that make un courses advantageously are joined end to end at lateral joints with other siding panels on the same course. It would be possible to have an arrangement in which panels are not strictly provided in rows, but instead are staggered. Nevertheless, horizontal abutments occur and require joints. Advantageously, the overlapped courses also have joints to affix the lower edge of each paneling course to the next lower overlapped course. Both endwise joints and overlap joints present practical problems.

For example, clearance is needed to accommodate thermal expansion and contraction. Siding materials such as vinyl and other polymers and resins often have a high coefficient of thermal expansion, and regularly cycle through a range of temperature conditions. Expansion is accommodated by providing clearance that permits the siding to expand at higher temperatures and to contract at lower temperatures.

One technique for clearance is to use fasteners (e.g., nails, screws, staples, etc.) that do not positively fix the siding to the underlying substrate (the building wall). The openings in the siding panels for receiving fasteners can have clearance in the direction of expansion/contraction. For example, lateral slots for receiving nails to hang the panels, allow for expansion or contraction in the direction of elongation of a panel course. If all the fasteners are placed at a midpoint in their respective slot, the panel can move in either direction relative to the fastener during expansion and contraction. That might or might not be the optimal placement of the fastener, depending on the ambient temperature at the time that the panel is installed. It also does not help or account for expansion and contraction in a direction perpendicular to the elongation of the course.

A given siding panel may have one tight reference hole, for receiving an anchoring nail at a predetermined point, and progressively elongated slots for other nails, so that the direction of expansion is controlled. Additionally, the installation instructions may dictate that the installer place the fasteners in a certain way. The siding panel also may have clearance in joints of overlapping courses.

Clearance is also needed so that the ends of panels that extend up to obstructions, or terminate at outside corners or the like, can be fitted under covering molding strips during installation. So-called J-moldings, for example, are used to frame windows and doors, where the moldings form channels to receive and cover the extreme ends of the panels. The panels need lateral clearance, along the direction of elongation of the course, so that the installer can fit each endmost panel into its course and then slide the panel endwise into the channel of the J-molding or similar trim. The channel or trim must be deep enough to cover the end of the adjacent panel when the panel and the course as a whole have retracted in cold weather. The fit of the panels and any joints along the course must be loose enough so the panels can slide as needed.

Regarding overlap joints, each joint needs to have a span of relative overlap at which the overlapping course remains attached to the overlapped course. This presents a quandary in that if there is a span, the installer cannot use the vertical joints as a means to reference the position of the next overlapping course relative to an installed course. The need for clearance is such that the new course cannot be pressed upwardly until the overlapped course is at its upper limit, because this should correspond to the most contracted temperature conditions for reasons of expansion/contraction. The span is also such that the installer cannot use the engagement of the next overlapping course to a previously installed course as a way to hold the next course temporarily in place, e.g., when reaching for a nail, etc. It would be advantageous if a more convenient solution could be found to the crossed purposes of providing a mechanical joint and allowing for thermal expansion and contraction from temperature differences above and below the ambient temperature at the time of installation.

The siding needs to cover the building area continuously without noticeable gaps between the panels under any conditions. Although it would be advantageous if installation could be handled without extensive attention to clearance and expansion/contraction issues, errors occur. These errors tend to become noticeable after the installation has been completed. Expansion and contraction issues, for example, may cause binding and buckling from insufficient expansion clearance. Lateral or overlap joints may become detached if thermal expansion exceeds the span of an overlap joint or contraction exceeds the span of a butt joint. Even apart from thermal expansion, any particularly complex joint structures, such as butt joints that have two or more elements that need to be engaged simultaneously, may be discovered after installation to have been only partially engaged. It would be advantageous if these problems could be handled in a more convenient and dependable way.

One proposal to achieve gap-less panel coverage while providing clearance for panels to slide in the direction of elongation of their course, is to structure butt joints between adjacent panels so as to permit a wide range of relative positions at which the abutted panels will engage while the joint remains attached. That is, the joint is designed to permit a substantial variation in the distance by which the panels can overlap more or less, or the complementary joint parts can be fitted into one another more or less deeply, while the panels are engaged and concealing the substrate. This approach actually makes it necessary to accommodate even more clearance during installation than is otherwise required. When assembling a butt joint, clearance is needed at the remote ends of the panels being joined. The necessary clearance must be as much as the insertion depth of the joint, because the panels are to be aligned while they are not engaged, and then moved endwise toward one another up to the depth of engagement or overlap.

A joint structure that can have a wide span of engagement depth or overlap can increase the tendency of the siding panels to be visible as discrete elements, particularly in cedar shake or wood shingle simulative panels, thus detracting from the original objective of making the panels simulate traditional building materials. The siding looks better if the joints are no deeper than necessary. The siding looks best when the joints between siding panels are not distinguishable from the simulated joints between the simulated shakes or shingles.

In some siding designs, the horizontally adjacent panels can simply be overlapped to form joints, in which case expansion and contraction respectively increase and decrease the amount of overlap, but the visible aspect of the joint is the end of the overlapping edge, namely a line and not a thickness that may vary. An overlap of adjacent siding panels is visually acceptable if the siding material is thin, such as extruded or formed vinyl sheet material simulating clapboards, which might be 0.035 to 0.050 inches thick. Overlapping is not practical in panel designs that have a thicker material such as injection molded polypropylene (also sometimes described as "vinyl" siding), which might typically be 0.080 to 0.150 inches thick. Overlapping is also not practical when the siding has a depth or thickness feature such as deep simulated wood grain or ridging, or if the siding design comprises discrete laterally positioned elements, such as wooden shingles or cedar shakes, which can be even thicker. These panels need some form of butt joints.

Butt jointed panels are generally made in relatively short lengths, e.g., 30 to 64 inches, which advantageously produce a large number of small expansion gaps over a given length instead of fewer larger gaps. One drawback is that the installer needs to assemble many such joints while also being appropriately concerned about all the other requirements such as placement of fasteners in slotted holes, correct alignment, position and vertical arrangement, etc.

Whether the butt jointed panels are relatively longer or shorter in the direction of elongation, there is still an issue as to expansion and contraction in a direction perpendicular to elongation of the courses (typically vertically). What is needed is a joint for overlapping edges that temporarily can hold the position of a next course to be installed, but also has a span of engagement so that the vertical joints as well as the horizontal joint can be appropriately installed in anticipation of subsequent expansion and contraction.

Referring to specific joint structures, butt joints for siding advantageously have attributes of overlap as well as attributes of male/female engagement. The overlap conceals the substrate under the joint. The complementary engagement of panel ends holds the panels in a plane. The joint ends of panels are not permitted to occur at the extreme ends of a course such as inside or outside corners or trimmed window or door frames. Instead those ends are cut. At the joints, for example, a step or rabbet along the edge of one siding panel can be overlapped by a complementary edge of the adjacent panel. Another possibility is a tongue and groove or analogous relationship wherein one panel edge fits into the adjacent panel edge. These relationships are directional and/or gender specific.

The panels are not reversible or invertible, which is to say that one end of a panel is complementary with the other end of a similar or mating panel (the left end of one panel always mates with the right end of the other). These aspects, and the further fact that such panels typically have vertically stepwise shapes, for simulation of two or more overlapping courses of clapboards or shingles, are such that the panels must be aligned before engaging their butt joints. The panels are assembled exclusively by first aligning one of the panels with the adjacent panel in the same course and then applying a force perpendicular to the plane of the joint abutment (i.e., precisely along the direction of elongation of the course, which is typically horizontal and parallel to the plane of the wall being sided). This displaces the panels toward one another, engaging and closing the butt joint. The displacement and clearance needed are equal to the depth of insertion of the mating parts of the joint, which is an uncertain distance that optimally is a function of installation temperature. The insertion should not entirely bottom out the joint, unless installation is occurring at the maximum possible ambient temperature. The insertion should be enough to ensure positive and complete mechanical engagement, even if installation is occurring at the minimum possible ambient temperature. The joint preferably engages easily and dependably, so that no incomplete joints are discovered and need to be repaired after several cycles of thermal expansion.

The foregoing issues relating to joints involving endwise abutment of siding panels can be appreciated, for example, from U.S. Pat. No. 6,301,856—Nasi. In that patent, injection molded siding is disclosed in courses that simulate traditional wood courses (such as clapboards). Each panel course has a sawtooth-cross section of thin plastic web, the web being shaped to form upper and lower shallow sloping parts and an intermediate step or edge between them. The outer surfaces of the two sloping parts simulate upper and lower wood courses. The step simulates the lower edge of the upper wood course. The stepped panel courses, each of which simulates plural wood courses, lap one another as already described.

The Nasi panels have tabs on the wall-facing back sides of the sloping parts. The tabs are integrally molded and placed at the panel edge, spaced from the back surface by the thickness of the panel material. A nip or slot is thereby formed between the back side of each sloping part and the molded tab, which grasps the edge of the next panel in line when inserted into the nip. This makes an endwise joint between the panels in a course. The Nasi panels, like similar such structures, need to be fitted together endwise, because the stepped sawtooth shape by which the panel courses simulate wood courses presents an obstruction against moving the panels over one another parallel to the building wall, while maintaining engagement of the tabs on the end of the next panel, in any direction other than co-linear end-to-end alignment.

The Nasi panels have detent teeth on the butt joint tabs. The detents define a particular point in the engagement of the joint, such as a minimum engagement that the installer can feel when moving the courses together. However, the detent is also a form of obstruction that will resist expansion. The detent cannot be considered a reliable reference because placement of the detent cannot take ambient temperature into consideration. The detent does not alleviate the need for insertion clearance.

It is not always convenient or sometimes even possible preliminarily to align panels end-to-end before making an end butt joint. For example when installing siding up to an obstruction such as a window frame with a J-molding, the siding panel needs to fit under the edge of the J-molding by some insertion distance, which dictates a need to slide the affected panel along the elongation of the course, away from the J-molding. That same panel needs to make a butt joint with the next panel disposed laterally outwardly. To make the butt joint, the installer must preliminarily displace the affected panel in the opposite direction relative to its final position, namely toward the J-molding, so as to line up the butt joint for insertion. Installers can try bowing the panel, if possible, or installing the whole course loosely until the panels that need to be joined are inserted into one another, or the whole arrangement of panel joints and moldings can be made loose enough to shift back and forth, perhaps with a detent to prevent complete disengagement as in Nasi.

Some looseness in the construction and jointing of the panels is necessary to accommodate thermal expansion. Looseness that is greater than necessary is undesirable, and detracts from the object of attractively simulating traditional wood siding. It would be advantageous to more effectively resolve the various needs for joint clearance, thermal expansion, temporary joint engagement and resistance of a joint against disengagement or partial engagement during installation.

SUMMARY OF THE INVENTION

According to an inventive aspect these problems are avoided by siding panels that have a butt joint structure that does not need to be aligned for insertion. The inventive joint can be engaged by normal longitudinal insertion, which requires preliminary alignment and endwise clearance prior to insertion as discussed. Additionally, the inventive joint can be engaged after a lateral insertion of the structures that make the joint, or by relative rotation of the panels being joined.

According to another aspect, a discontinuous tab and slot arrangement is provided for at least the butt joints of siding panels. The engageable tabs and slots are provided with lead-in ramp edges that facilitate engagement and thereby reduce the incidence of partial joint engagement. Inasmuch as the joints are engageable without the need for endwise clearance, the longitudinal insertion depth can be large without a corresponding need for endwise clearance. Furthermore, the tabs and slots are arranged to engage frictionally, preferably both in the butt joints and in overlap joints, so that the installer can temporarily affix a next course to an installed course, the temporary position being held by the joints, permitting fine adjustments of spacing and joint gap.

The inventive joint preferably is applied to a panel structure having two or more simulated lapped courses or tiers. As such, insertion using a motion other than longitudinal insertion can be facilitated by providing a gap in a portion of the panel structure where part of the end of the panel at one tier can be passed through a gap associated with the other tier or with a connection line between the tiers, when moving the joint forming members of the two panels into engagement.

The part of the panel passed through the gap can be a tenon or tab of one side of the joint, or can be a clip or block forming a mortise forming part. In one arrangement, a tab or tenon is received in a mortise having an open side for at least part of the depth of the mortise, whereby the tab or tenon can be laterally moved into the mortise instead of being inserted exclusively by longitudinal movement.

Accordingly, the invention provides a panel, particularly for polypropylene and other similar siding materials, and also for applications similar to siding, mounted in lapped courses with butt joints at which panels attach in a direction of elongation. The opposite ends have complementary tabs, edges forming tabs and/or slots that fit together to joint the panels by a normal end-to-end approach of the abutting panels. According to an aspect of the invention, openings for the tabs also permit engagement by relative movement in a direction perpendicular to that normal direction. This reduces or eliminates the need for assembly space.

The slots can be formed by tabs raised from the back side of edges on one end of the panel arranged to overlap concealed edges on the other end of the panel. A slot is defined between each such tab and such back side, which slot is discontinuous because it is formed by one or more discrete tabs. The concealed under-lap edge at said other end of each panel has gaps through which the tabs can be fit, thus placing the under-lap edge in position to be engaged under the tabs, i.e., aligning the under-lap edges to the slots edgewise.

In the case of two or more tabs and/or gaps for a given length of panel, the tabs and the solid parts of the under-lap edge form fingers that can be interleaved. Interleaving the raised tabs through parts of the under-lap edge between the gaps allows the installer relatively to position the under-lap edges in line with the slots formed between the raised tabs and the backside surfaces of overlap edges. The motion is at least partly normal to the plane of the surface on which the siding is to be installed. After interleaving, the panels are relatively moved at least partly parallel to the surface and perpendicular to the direction of elongation of panels, thus placing portions of the under-lap edge between respective tabs and overlap edges on the backside of the panels. The joint is made without the need for endwise clearance in the direction of elongation of the panels.

In another aspect the panels simulate wood courses having a step, for example between simulated courses. A gap is provided in the edge of the panel at the step, thus forming an opening into the slot.

BRIEF DESCRIPTION OF THE DRAWINGS

The foregoing features and advantages of the invention, as well as other aspects and routine extensions of the invention, are apparent from the following detailed description of examples and preferred embodiments, to be considered together with the accompanying drawings, wherein the same reference numbers have been used throughout to refer to the same functioning parts, and wherein.

DETAILED DESCRIPTION

Figure 1:
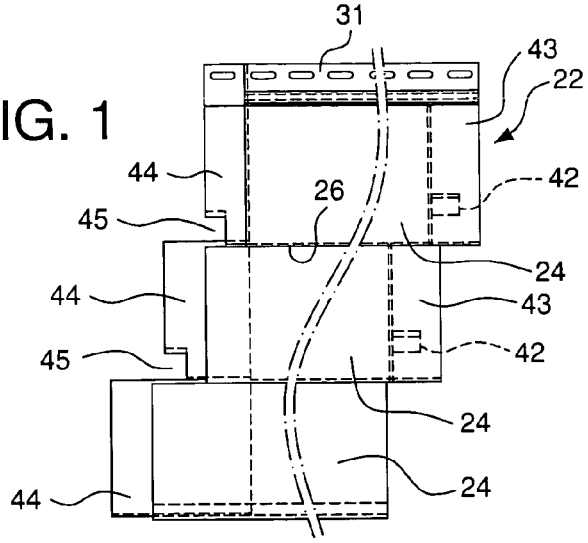
FIG. 1 is an elevation view showing a siding panel according to one embodiment of the invention.

A number of exemplary embodiments of the invention are described herein with reference to the drawings. These embodiments are examples intended to demonstrate aspects of the invention in different forms or separately. Not all the aspects are required in all embodiments of the invention, and the illustrated embodiments should be regarded as exemplary rather than limiting.

For example, the illustrative embodiments discussed concern building siding materials of the sort typically installed in horizontally elongated courses on external building surfaces that are vertical and flat. However, the nature of the installation surface and whether or not the courses are elongated horizontally, are subject to variation. For example, the surface could be sloping (such as a roof) or curved. The direction of elongation of the panels could be vertical or inclined instead of horizontal. The application could be an exterior or interior building application or an application that is not related to a building per se. Therefore, in this description, terms denoting relative directions and orientations such as "lower," "upper," "horizontal," "vertical," "above," "below," "up," "down," "top" and "bottom" should be construed to refer to the orientation as then being described or as shown in the drawing under discussion.

Terms concerning attachments, coupling and the like, such as "connected" and "interconnected," refer to a relationship wherein elements are integral parts of a whole, or are secured or attached to one another either directly or indirectly through intervening structures, as well as both movable or rigid attachments or relationships, unless expressly described otherwise or as apparent in view of the described functions of such elements.

Figure 2:
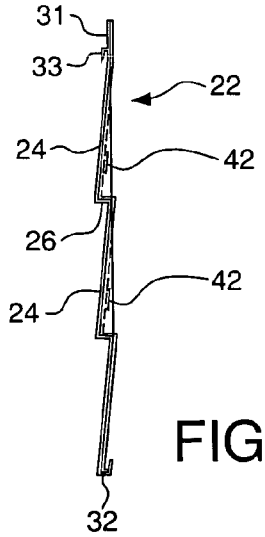
FIG. 2 is an end elevation of the siding panel shown in FIG. 1.

Referring to FIGS. 1 and 2, an exemplary siding panel 22 is provided for facing a surface such as a structural surface of a building substantially defining a plane. Typically but not exclusively, siding panels of this type are attached to the external vertical walls of buildings, in horizontally elongated courses that are intended to simulate traditional siding materials such as wood.

It is possible to embody the invention such that one course of paneling equates with one simulated course of wood or other siding material. In the embodiment shown in FIGS. 1–3*b*, each integral siding panel 22 is shaped with three sloping faces 24 joined at stepped edges 26. The faces simulate the exposed parts of shingles, shakes, clapboards or the like. The edges 26 simulate the lower edge of an upper shingle or the like, lapped over the surface of the next lower shingle, etc. There are various possibilities for simulative and decorative particulars. For example, the panels 22 can have simulated vertically elongated gaps delineating shingles placed next to one another, arranged to appear random as shown in FIG. 3*a*.

Figure 3A:
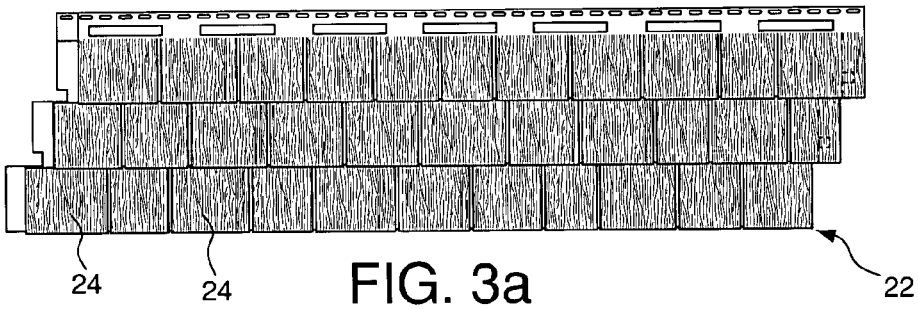
FIG. 3*a* is an elevation view showing the siding panel of FIG. 1 assembled into a course wherein one such siding panel course represents three lapped courses of smaller panels.

It is possible for the panels 22 to be relatively longer or shorter in their respective courses, e.g., one shingle in the direction of elongation as shown in FIG. 1, or several repetitions of shingle patterns as shown in FIG. 3*a*, with the panels 22 each being some convenient length such as four or eight feet. Thermal expansion variations can be distributed by making the panels a relatively short standard size, for example sixty inches in length. Each panel 22 has complementary joint structures at its opposite ends.

The panels 22 each have a nailing strip 31 along an elongated edge (the top edge as shown) with slots for receiving nails. The slots provide clearance for the paneling to expand and contract although nails (not shown) are fixed in the structure to support the panel 22. The panels are formed with an upwardly opening hooked rear channel 32 at their lower edges and a downwardly opening hooked front channel 33 just below the nailing strip. These hooked channels engage with one another to join successive courses along their top and bottom edges. Specifically, after installing one or more panels on a lower course, a panel 22 for the next upper course is overlapped on the installed panel sufficiently to place the bottom rear hook 32 below the top front hook 33 of the installed panel. The installer slides the overlapped panel upwardly to engage the hooks 32, 33 and nails through the nailing strip 31 of the overlapped panel.

Figure 3B:
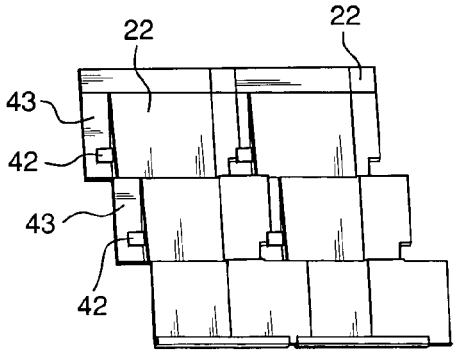
FIG. 3*b* is an elevation view of one panel as in FIGS. 1–3, seen from the back or building wall side of the panel.

An aspect of the present invention is the manner in which the panels 22, shown respectively from their external and internal sides in FIGS. 1 and 3*b*, are joined in end-to-end abutment with other panels having similar end structures, so that the array of abutted panels 22 covers a surface as shown in FIG. 3*a*.

In the embodiment of FIGS. 1–4, one or more of the sloping faces 24 that simulate wood courses or the like, is provided with a rear tab 42 disposed at a slight space behind the rear surface of an overlap edge 43 on one end of panel 22. The overlap edge will be visible in the finished array shown in FIG. 3*a*.

On the opposite end of the panel 22 from the exposed overlap edge 43 is a under-lap edge 44. The under-lap edge 44 will be disposed under the overlap edge 43 of the next adjacent panel 22. The under-lap edge 44 of one or more simulated courses in each panel 22 (specifically the upper two of three in the embodiment shown) is received between the rear tab 42 and the back side of the overlap edge 43 of the endwise abutting panel 22, making a joint. The joint holds the corresponding exposed parts of the panels 22 coplanar (i.e., faces 24 and steps 26). A given panel can be freely displaced laterally only up to the point at which the joint with the next adjacent panel 22 bottoms out.

Although the under-lap edge covers a reasonably substantial distance and can thus prevent the building surface from showing through between the panels, it is advantageous if the overlap edge covers the under-lap edge by a distance that is nearly equal (given temperature variations) to any simulated gaps intended to delineate simulated shingles. In this way, the siding surface as shown in FIG. 3*a* convincingly appears as an array of single shingles. The gaps between panels 22 (each representing a number of shingles), if accurate, tend to be indistinguishable from the simulated gaps. The identities of the panels 22 disappear in the array.

It is desirable accurately to position the panels 22 that abut endwise against one another in a given course. The gap distance preferably is just sufficient to prevent interference when the siding has expanded to the maximum expected according to temperature specifications.

The panels are installed by planning the coverane of an area between inside and outside corners, obstructions such as windows and doorways, and the top and bottom edges, so that joints will not fall at the ends of courses or sections of courses. In this way, the extreme ends of the course will be cut at a point spaced at least from the under-lap edge strip 44. In order to make a joint that engages under-lap edge 44 behind tab 42, it is necessary to provide some end-to-end clearance to get the rim of under-lap edge 44 around the end of tab 42. It is normally not possible to engage the abutting panels 22 in any direction or relative orientation except end-to-end alignment, because the overlap edges 43, and the under-lap edges 44 each have the sawtooth contour shown in FIG. 2. The sawtooth pattern prevents overlapping panels from resting in surface contact unless they are aligned so their sawtooth patterns nest. The sawtooth pattern prevents one from slipping the tab 42 on one side of the joint laterally over the under-lap edge of the next panel because the steps 26 present obstructions that block the tabs 42.

According to an inventive aspect, a gap 45 (best seen in FIGS. 1 and 4) permits the tab 42 to pass. The gap 45 comprises an opening at least at the edge of the step 26 adjacent to the under-lap edge 44. Preferably, the gap 45 extends into the bottom part of the under-lap edge as well. By providing this opening via gap 45 for tab 42, the panels 22 are made capable of assembly using motions other than bayonet-type insertion after preliminary alignment. This aspect of the invention removes the obstructing parts of step 26 and the under-lap edge 44 in the area of tab 42. Therefore, even though panels 22 have a sawtooth contour, they can be joined by a lateral displacement of the end having tab 42, e.g., sliding a lower panel 22 upwardly (or on the end with under-lap edge 44 sliding a panel downwardly) to make the joint. This motion is shown in FIG. 5*a*. As shown, there is little or no need for endwise clearance. The panels can be assembled easily right up against an obstruction 50 as shown.

Figure 5A:
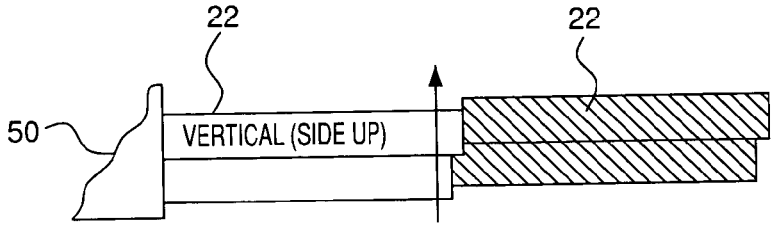
FIGS. 5*a*, 5*b*, 5*c* are schematic illustrations that illustrate alterative assembly motions that are possible according to the invention as shown in FIGS. 1–4.
Figure 5B:
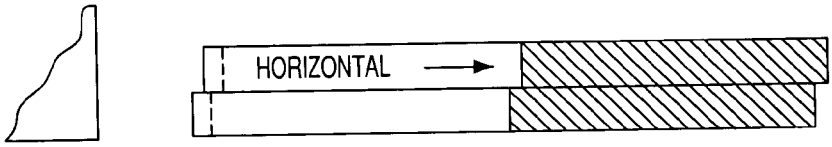
Figure 5C:
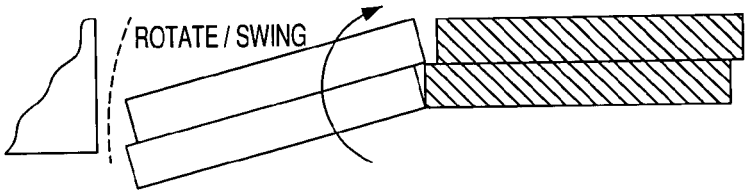

It remains possible according to the invention to align the panels 22 and move them together horizontally as shown in FIG. 5*b*, for example when there is clearance before the next obstruction 50 becomes an issue. According to the invention, it is also possible to rotate a panel 22 into position, as shown in FIG. 5*c*.

In the embodiment of FIG. 1, two of three simulative courses have tabs 42, and tabs 42 can be engaged around the under-lap edge by passing at least part of tab 42 through gap 45. An alternative embodiment is shown in FIGS. 6–11, using the same reference numbers for comparable structures. This embodiment uses a similar gap structure wherein a set of tabs 42 are provided and interact with corresponding gaps in one or both of the under-lap edge 44 and the step 26 of the adjacent panel 22. This embodiment has two simulated courses. Two of the tabs 42 are disposed on the upper course, and one on the lower course.

Figure 6:
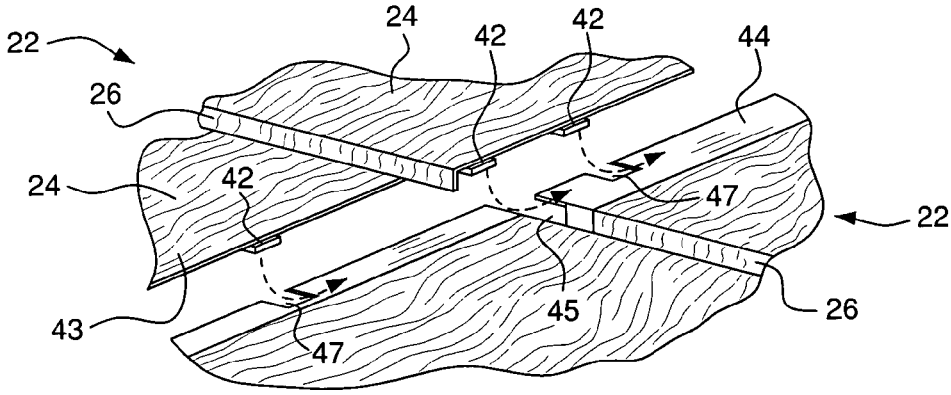
FIG. 6 is a perspective illustration of an alternative embodiment having a different tab arrangement from the embodiment of FIGS. 1–4.

As shown in FIG. 6, the tab that resides above the step 26 in the assembled state is placed at a short space from the step on the back side of overlap edge 43. During assembly, the tab near step 26 passes through the gap 45 in the corresponding step 26 of the under-lap edge.

Additionally, one or more tabs 42 are placed at a greater space from step 26 and in the assembled state hold together the material of the sloping faces 24 at the overlap/underlap edges of the simulated courses. The tabs 42 that are not associated with the step 26 are passed though gaps 47 along the underlap edge at the sloping surfaces 24. These tabs are placed so that the tabs 42 at the sloping surfaces 24 are respectively positioned directly over their corresponding gaps 47 when the tab 42 at step 26 is positioned immediately below step 26 (i.e., poised for insertion into gap 45). Thus the panels are securely joined, aligned and placed by pressing the overlapping panel down against the underlapping panel, thereby pressing tabs 42 into gaps 47, and then sliding the overlapping panel up until the step 26 of the overlapping panel 26 rests against the corresponding step 26 of the underlapping panel. As a result of those movement steps, the underlap edge 44 becomes fixed in a channel defined between tabs 42 and the back side of the overlap edge. The abutting panels 22 are then coplanar and in alignment.

As apparent from the foregoing description, slots are formed by tabs 42 being from the point of their connection with the underside of the overlap edges 43, out to the ends of the tabs 42. The tabs 42 can extend clear to the extreme edge of the overlap edges, or can be spaced back slightly, so long as the connection can be made with the underlap edge.

The tabs and their slots form complementary discontinuous elements that are positioned so as to be interleaved for relative insertion in a direction normal to the plane of the siding. The complementary elements form a slot between the tabs 42 and the back sides of the overlap edges. This slot is sawtooth shaped in cross section. However, the sawtooth shape does not prevent the complementary joint structures from engaging when the panels slide over one another, parallel to the building surface and perpendicular to the elongation of the panels 22, because gap 45 in the step 26 of the underlap edge 44 removes the interference that would otherwise be caused by step 26 of underlap edge 44.

Furthermore, apart from the gap 45, the surface gaps 47 (see FIG. 6) allow the tabs 42 to be moved into engagement with the underlap edge of the adjacent panel 22 in the downward-insertion and upward-locking "L" shaped movement of the overlapping panel 22 relative to the underlapping one. It is not necessary to move the panels 22 relative to one another in the direction of their elongation, so no clearance is needed.

A number of identical panels 22 can be mounted on the structural surface (e.g., an exterior vertical wall of a building) parallel to one another along a horizontal direction of elongation, in lapped courses. Of course, other sites of application and other mounting orientations are possible as well. The panels 22 can have any number of simulated courses. However, one to three simulated courses (i.e., one to three sloping surfaces 24 joined at steps 26) are preferred. If there are more than a few tabs 42 to be inserted through gaps 47, followed by sliding one or more tabs 42 through gap(s) 45, it can become difficult to get all of the tabs 42 into gaps 47 and placed to receive parts of the underlap edge 44 at the same time.

It is possible to apply the invention to an embodiment in which only certain of the panels 22 used on a building surface comprise butt joint structures as described. Preferably, however, the entire surface is faced using identical panels 22. All the joints between the panels 22 are made by joining the complementary panels end to end in the direction of elongation. In the embodiment described, the left and right ends of the panels are gender specific, i.e., with all the panels 22 having tabs facing in one direction (at the overlap edge) and gaps 45, 47 in the other direction. In another embodiment, the genders of these connections can be mixed, e.g., with some panels or courses having joints wherein the overlap is right to left and others having an overlap the is left to right, etc. The panels can also be used in conjunction with panels of other types, e.g., panels that lack similar joints or have joints that can only be inserted in the direction of elongation. In any event, the inventive panels have first and second ends of which the first end of one of the panels mates with the second end of another of the panels as described.

The complementary joint structures comprise at least one of tabs and slots by which the first and second ends are engageable by end to end insertion in the direction of elongation. In one embodiment, the panels are injection molded polypropylene siding. The tabs 42 that form discontinuous slots against the back side of the overlap edge 43, or a similar structure forming discontinuous slots along an edge of panel 22, can thus be integrally formed with the other elements of the siding panels, in the injection molding process.

Inasmuch as the panels, and in particular the tabs, slots and/or edges that meet and preferably overlap at the joints, are structured to enable the first and second ends of the joined panels 22 to be engaged by relative movement in a direction perpendicular to the direction of elongation of the panels. Movement in a direction normal to the building surface permits interleaving of the discontinuous slot/tab/edge sections that are to engage, e.g., passage of the tab 42 through the plane of the mating underlap edge 44 such that the underlap edge 44 is aligned to the slot formed between the tab 42 and the backside of the overlap edge 43. Thereafter, sliding the edge along the slot attaches the panels end to end. Little or no clearance is needed in the direction of elongation.

In the disclosed embodiments, the tabs and/or slots as well as the edges that they engage are provided by web portions that are parallel to the plane of the structural surface. Discontinuous portions of these web portions are laid upon or spaced from such plane, by different distances. The discontinuous nature of the different levels allows them to be passed into or interleaved with one another. Sliding the interleaved levels along the joint (perpendicular to elongation of the panels 22) causes the joints to lock. The panels 22 are alternatively fittable in that way or on the conventional direction by which the joint forming ends of the panels can be simply inserted endwise into one another in the direction of elongation.

In the embodiments simulating plural courses of wood or other panel materials, the sawtooth cross section of each panel is formed by at least one upper and at least one lower sloping flat part, integrally joined at a step along a lower edge of the upper sloping flat part, the panel thereby forming at least two courses of said sloping flat parts. The panel can have other numbers of simulative courses, including one simulated course, wherein the step is associated with the lower edge, or three or more simulated courses, of which all or only a subset have tabs 42 as described.

The invention can be considered a method for joining abutting ends of panels covering a surface in courses. The method comprises providing a panel structure as described. The panel has a sawtooth cross section with at least two sloping parts joined by a step at a lower edge of an upper one of the sloping parts. Complementary joint structures face in opposite directions along an elongation of the panels, whereof a first end of one such panel joins to a second end of another such panel. A tab or web is raised from a back side surface of one of the first and second end, placed to capture an edge of the other of the first and second end between the tab and the back side surface, at a position above the step on said other of the first and second end. According to one aspect, an opening clearance is provided in the step at the lower edge of the upper one of the sloping parts. Thus assembling the panels, namely joining their abutting ends, comprises passing the tab through the opening clearance in the step when affixing the complementary joint structures.

According to a further aspect, at least one additional tab is provided along at least one of the upper and lower sloping surfaces and is aligned to a gap along an edge of one of the upper and lower sloping surfaces for the additional tab. The gap along the edge is between an initial and final position of the tab. The joining steps thus further comprise laying the first and second ends of the panels over one another, pressing the additional tab through the gap along the edge, and, displacing the first and second ends relative to one another so as to capture the edge of one said panel between the back side surface and the respective tab and additional tab another said panel, the tab passing through the opening clearance when displacing said first and second ends.

FIGS. 1–4 as discussed above disclose a panel with three simulated courses wherein two of the simulated courses are joined with tabs and gaps to engage the tabs in the L-shaped motion described. FIGS. 7–11 show another practical embodiment, this time having two simulated courses. Each of the simulated courses has a gap 47 in the sloping panel section for a tab 42. In addition, a further tab 42 passes through a gap 45 in the step 26.

Figure 7:
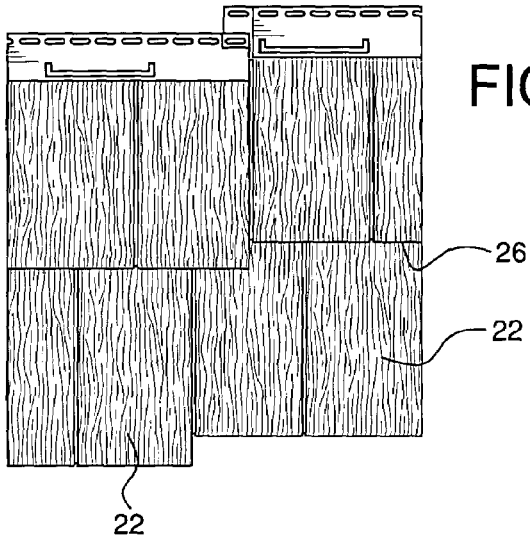
FIG. 7 is an elevation view illustrating an assembly step corresponding substantially to FIG. 4.
Figure 8:
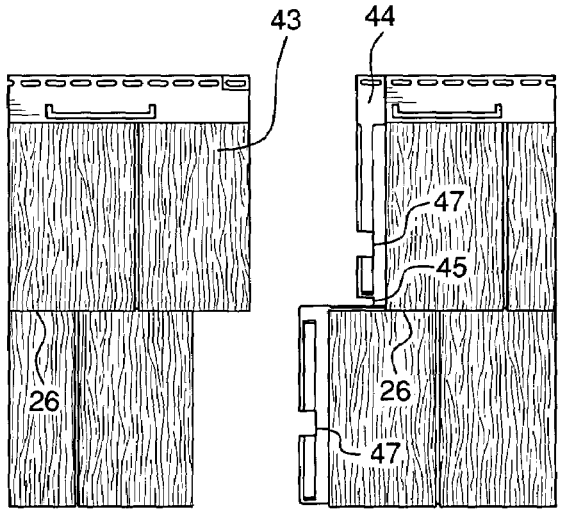
FIG. 8 is an elevation view showing the front side appearance of the complementary ends of the panel.

In FIG. 7, the overlapping panel on the left has been placed against the underlapping panel on the right. The panels have the structure as described above, also shown in FIG. 8, wherein the panels have gaps 45, 47 and tabs as shown in FIG. 6.

Figure 9:
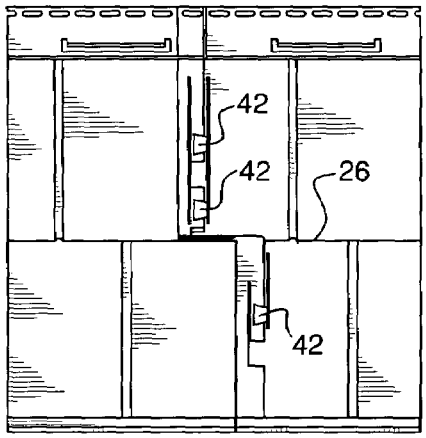
FIG. 9 is a rear elevation view showing the panel joint assembled (which would be a view from the inside of the sided structure outwardly.

FIG. 9 shows the finished joint from the back side. The tabs 42 have been moved along the web material of the underlap edge 44, which is not fixed between the tabs 42 and the back side of the overlap edge.

Figure 10:
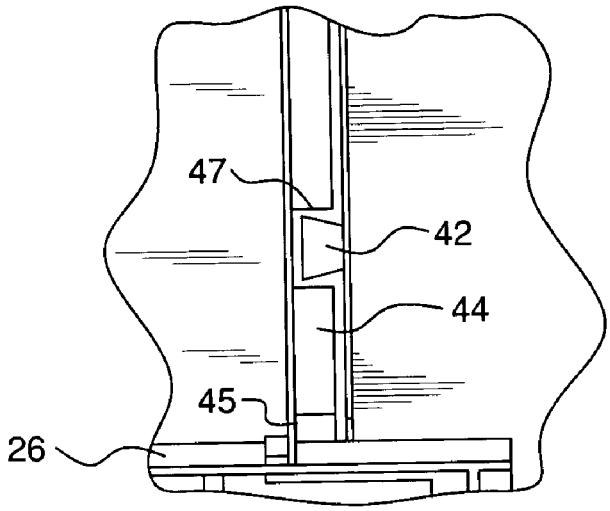
FIG. 10 is a detailed rear elevation showing the back side surfaces adjacent to the bottom edge of an upper sloping surface (i.e., at and above the step), during an initial stage of assembly.
Figure 11:
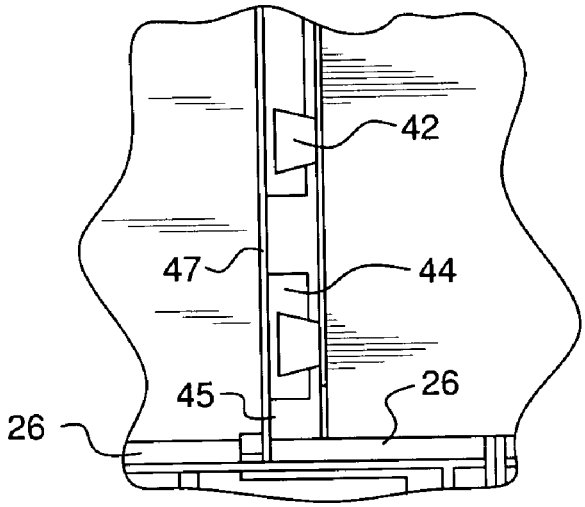
FIG. 11 is a detailed section view corresponding to FIG. 11 and showing the final stage of assembly.

FIGS. 10 and 11 show the joint exclusively at and above the step 26, from the rear. The tabs 42 are inserted through gaps 47 in FIG. 10, in the first leg of the L-motion that assembles the panels, but not yet through gap 45. In FIG. 11, the second leg of the L-motion has been completed and the joint is locked.

Figure 12:
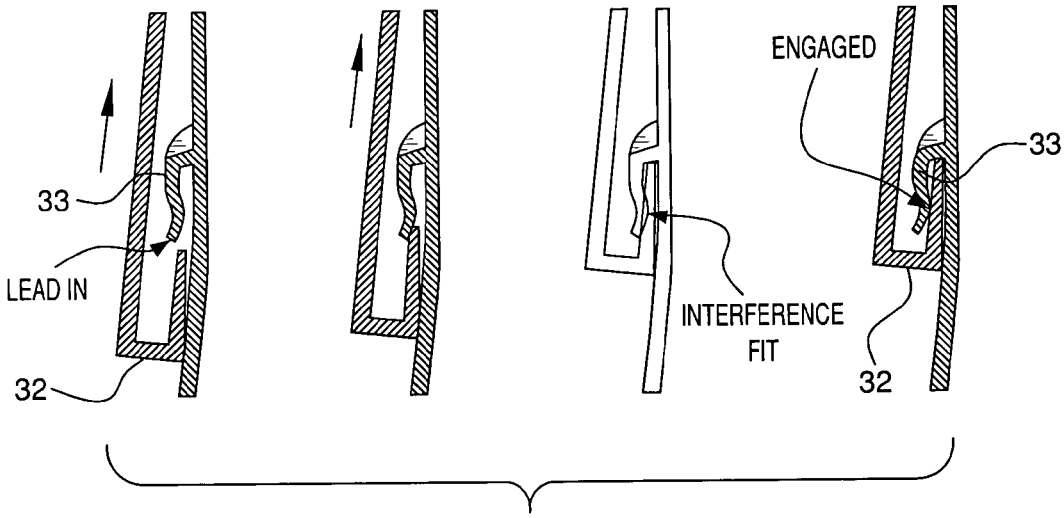
FIG. 12 is a section view showing an inventive joint for butt or overlap engagement, shown in several stages of engagement.

FIG. 12 is a section view showing a specific cross sectional shape that can be used in a joint as described wherein a tab spaced from the back side of the panel engages the edge of another panel across a joint. FIG. 12 shows the shape applied to an overlap joint of hooks 32, 33, but also can be applied to tabs 42 and openings 45, 47 (not shown in FIG. 12).

Figure 4:
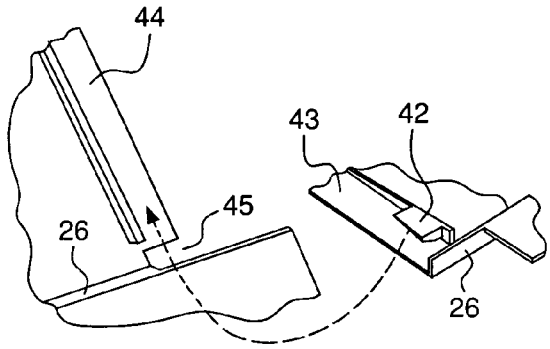
FIG. 4 is a partial schematic isometric view showing the manner in which the tab of one panel is inserted through a gap in an abutting panel.

Preferably, each tab 42 is tapered endwise and on the edge facing toward the complementary edge of opening 45 or 47 (see FIG. 4). Likewise the edge of opening 45, 47 can define a taper or ramp at the leading edge that is to be engaged by a respective tab 42. In FIG. 12, the same shape is shown for the overlap joint. The edges of the tab 42 and the slot or opening 45, 47 (or the corresponding edges of hooks 32, 33) are tapered on their receiving edges. This taper or ramp feature allows the joint to mate easily by guiding the tab into the slot, and reduces the incidence of partial engagement (such as situations in which certain tabs 42 have failed to engage and are actually resting on the outer side of the adjacent panel after installation).

In the embodiment shown in FIG. 12, the downward hook 33 has a curved shape wherein the ramp at the leading edge leads to a pinch point of minimum slot width, at which an interference fit is obtained with the distal web of the upward hook 32, which is also tapered on the leading edge. This structure has particular advantages because the interference fit at the point of minimum slot width provides a tactile indication to the installer, when the hooks 32, 33 are engaged up to a particular point. The tactile indication of resistance is not unlike the resistance of a detent, but unlike a detent does not produce a snap or positive obstruction at a particular insertion distance. The tapered parts and the interference fit at the cusp along hook 33 as shown in FIG. 12 have the advantages of a detent without the disadvantage of fixing a specific position or insertion distance that should instead depend on the ambient temperature versus nominal temperature expectations as described above.

The interference fit in FIG. 12 enables a course that is being installed to be held temporarily by an already-installed course due to the frictional engagement of hooks 32, 33. The temporary engagement, without fixing relative positions as would be the case with a detent or a hook with a positive barb, allows the installer to make fine adjustments in the position of the panel while it is held frictionally close to a final position. At the same time, the frictional support permits the installer to release his or her grip on the panel, for example to reach for a nail. The frictional support also can wholly or partly support the panel while the installer's attention is directed to making the attachments of tabs 42 and openings 45 and/or 47 in the butt joint. The frictional engagement can be a bend or rounded bump in the female-side hook 33 versus a taper in the male-side hook 32, or another form of frictional engagement that operates without positively fixing a supporting position.

The lap joint as described, namely with an interference fit made along the vertically overlapped upper and lower edges of panel courses, is especially apt when provided together with the butt joint structure described above. The butt joint structure makes it possible to assemble the butt joint, between panels along the same course (typically in the same line of horizontal elongation), by moving the panel being installed in a substantially vertical direction relative to the last previously installed panel in the same course. Alternatively, the motion is inwardly and normal to the plane of the wall, followed by an upward movement.

The lap joint is also generally applicable to a panel body structured for mounting in horizontally elongated courses having a vertical overlap at which a lower edge of an upper panel overlies an upper edge of a lower panel. At least one upwardly opening hook 32 adjacent to the lower edge of the upper panel, mates with at least one downwardly opening hook 33 adjacent to the upper edge of the lower panel. The upwardly opening hook and the downwardly opening hook engage with a frictional interference fit, preferably sufficient to support the upper panel temporarily during installation, by engagement of the upwardly and downwardly opening hooks.

To facilitate installation notwithstanding the frictionally tight arrangement of hooks 32, 33, at least one of the upwardly and downwardly opening hooks, namely the downwardly opening hook 33 in the embodiment shown in FIG. 12, comprises a flange spaced from a plane of the panel body, wherein the flange is at least partly flared in a direction away from the plane of the panel body, thereby providing a lead-in for engagement of the hooks. This embodiment also shows that hook 33 can be buttressed by one or more ridges disposed outside and against the hook opening, thus contributing to the strength of hook 33 and to the extent to which hook 33 can exert a pinching pressure on the flange of hook 32 to hold the lower panel in place, temporarily during installation, by the frictional interference fit of hooks 32, 33.

Figure 13:
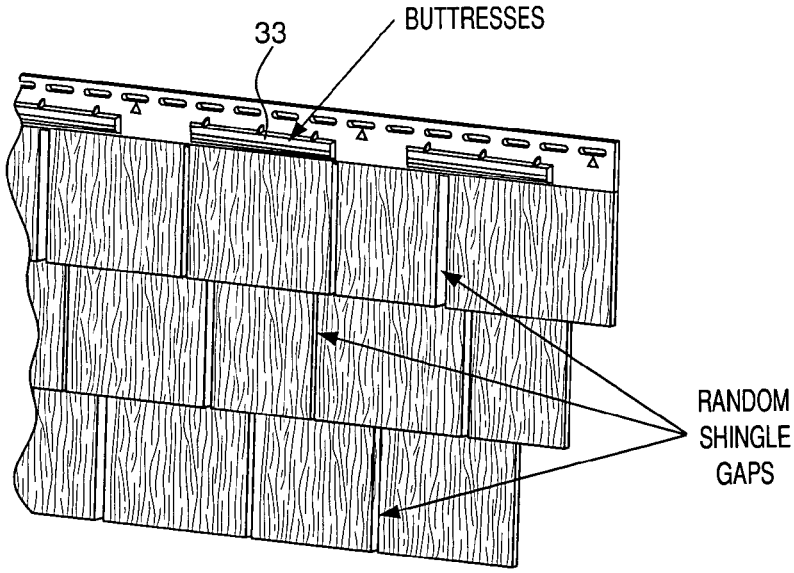
FIG. 13 is an elevation view showing a preferred arrangement for shingle or shake siding, having reinforced overlap joints, nailing markers and randomized simulated shingle spacing.

FIG. 13 is an elevation view showing additional preferred arrangements for shingle or shake siding incorporating the aspects of the invention. In addition to the frictional engagement of the hooks 32, 33, at least one of the hooks 32 33 (namely hook 33 as shown) is reinforced by buttress webs placed immediately adjacent to the hooks. These buttresses are helpful to improve the strength of frictional engagement and also reduce breakage, particularly when the weather is cold and the polymer siding material (or other similar material) is brittle. Otherwise breakage can occur if the installer vigorously engages the respective hooks 32, 33. This embodiment is also characterized by molded-in nailing markers at each $n^{th}$ nail slot to indicate maximum nail spacing without the need for measurement. This embodiment also is characterized by randomized gap spacing between the simulated shingles, which is helpful to camouflage the gaps between panels because one or more of the randomized gaps between the ends of each panel is likely to be of nearly the same width as the gaps between panels, even as the latter vary with temperature.

The invention has been disclosed in connection with certain examples and embodiments but is not limited to the particular constructions herein disclosed and shown in the drawings, but also comprises any modifications or equivalents within the scope of the appended claims.

What is claimed is:

1. A siding panel for facing a structural surface substantially defining a plane, wherein:

a plurality of such panels are mountable on the structural surface parallel to one another along a direction of elongation, in lapped courses;

at least certain of the building panels comprise butt joint structures joining said certain building panels with other such panels end to end in the direction of elongation, and wherein the panels have first and second ends of which the first end of one of the panels mates with the second end of another of the panels; and, wherein the complementary joint structures comprise at least one of edges and slots by which the first and second ends are engageable by end to end insertion in the direction of elongation, and said at least one of the edges and slots is formed by discontinuous lengths that are spaced so as to permit overlapping edges of the panels to pass between one another in a direction perpendicular to the plane of the surface, whereupon subsequent displacement parallel to the plane of the surface engages the first and second ends.

2. The siding panel of claim 1, wherein said at least one of the edges and slots are formed by substantially parallel web portions spaced from the plane of the structural surface, alternatively fittable into one another along the direction of elongation, and along a direction perpendicular to the direction of elongation and parallel to the plane of the surface.

3. The siding panel of claim 1, wherein each of the panels forms a sawtooth in cross section, with at least an upper and a lower sloping flat part being integrally joined at a step along a lower edge of the upper sloping flat part, the panel thereby forming at least two courses of said sloping flat parts.

4. The siding panel of claim 1, wherein the butt joint structure comprises at least one tab spaced from a back side surface of one of the first and second ends by a distance substantially equal to a thickness of the other of the first and second ends that fits between the tab and the back side surface in an end-wise overlap of the first and second ends.

5. The siding panel of claim 1, wherein at least one of the edges and the slots is tapered in an insertion direction.

6. A siding panel for facing a structural surface substantially defining a plane, wherein:

a plurality of such panels are mountable on the structural surface parallel to one another along a direction of elongation, in lapped courses;

at least certain of the building panels comprise butt joint structures joining said certain building panels with other such panels end to end in the direction of elongation, and wherein the panels have first and second ends of which the first end of one of the panels mates with the second end of another of the panels;

wherein at least one of the first and second ends has two parallel web portions spaced apart in a direction normal to the plane of the structural surface, the two parallel web portions being spaced by substantially a thickness of an edge of the other of the at least one of the first and second ends, received between the two parallel web portions for joining the panels end to end;

wherein the two parallel web portions are discontinuous in a lapping direction parallel to the surface and perpendicular to the direction of elongation, forming tabs and gaps that are positioned to pass laterally into one another, whereupon subsequent displacement in the lapping direction joins the first and second ends; and, wherein each of the panels forms a sawtooth in cross section, with at least an upper and a lower sloping flat part being integrally joined at a step along a lower edge of the upper sloping flat part, the panel thereby forming at least two courses of said sloping flat parts.

7. The siding panel of claim 6, wherein the butt joint structure comprises at least one tab spaced from a back side surface of one of the first and second ends by a distance substantially equal to a thickness of the other of the first and second ends that fits between the tab and the back side surface in an end-wise overlap of the first and second ends.

8. The siding panel of claim 7, wherein the tab is placed adjacent to the step at the lower edge of the upper sloping flat part.

9. The siding panel of claim 7, wherein the step at the lower edge of the upper sloping flat part at one of the first and second ends is cut away from an edge of the panel by a clearance distance permitting an engaging part of the other of the first and second ends to pass between the upper and lower sloping flat parts.

10. The siding panel of claim 6, wherein at least one of the web portions is tapered in an insertion direction.

11. The siding panel of claim 10, wherein at least one of the web portions is shaped to form a frictional restriction that engages without a specific detent position.

12. The siding panel of claim 6, wherein said web portions are alternatively fittable into one another along the direction of elongation, and along a direction perpendicular to the direction of elongation and parallel to the plane of the surface.

13. The siding panel of claim 6, wherein said web portions are formed by discontinuous lengths that are spaced so as to permit overlapping edges of the panels to pass between one another in a direction perpendicular to the plane of the surface, whereupon subsequent displacement parallel to the plane of the surface engages the first and second ends.

14. A method for joining abutting ends of panels covering a surface in courses, comprising:

providing a panel structure having a sawtooth cross section with at least two sloping parts joined by a step at a lower edge of an upper one of the sloping parts, and complementary joint structures facing in opposite directions along an elongation of the panels, whereof a first end of one such panel joins to a second end of another such panel;

providing a tab raised from a back side surface of one of the first and second end, placed to capture an edge of the other of the first and second end between the tab and the back side surface, at a position above the step on said other of the first and second end;

providing an opening clearance in the step at the lower edge of the upper one of the sloping parts;

passing the tab through the opening clearance in the step when affixing the complementary joint structures providing at least one additional tab along at least one of the upper and lower sloping surfaces;

providing a gap along an edge of one of the upper and lower sloping surfaces for the additional tab, said gap along the edge being relatively lower than a final position of the tab;

laying the first and second ends of the panels over one another;

pressing the additional tab through the gap along the edge; and, displacing the first and second ends relative to one another so as to capture the edge of one said panel between the back side surface and the respective tab and additional tab another said panel, the tab passing through the opening clearance when displacing said first and second ends.

15. The method of claim 14, comprising providing the additional tab on each of the upper and lower sloping surfaces.

16. The method of claim 14, further comprising engaging one of said panels during installation, by a frictional engagement with an installed second one of said panels, at least at one of a butt joint and an overlap joint, and temporarily holding said one of the panels.

17. The method of claim 16, wherein said frictional engagement is made over a span of insertion depth of said one of the butt joint and the overlap joint, without defining a temperature dependent position.

* * * * *